US008596745B2

(12) United States Patent
Koseki

(10) Patent No.: US 8,596,745 B2
(45) Date of Patent: Dec. 3, 2013

(54) LIQUID JET HEAD AND LIQUID JET APPARATUS

(75) Inventor: Osamu Koseki, Chiba (JP)

(73) Assignee: SII Printek Inc. (JP)

( * ) Notice: Subject to any disclaimer, the term of this patent is extended or adjusted under 35 U.S.C. 154(b) by 198 days.

(21) Appl. No.: 13/134,037

(22) Filed: May 26, 2011

(65) Prior Publication Data

US 2011/0292115 A1 Dec. 1, 2011

(30) Foreign Application Priority Data

May 31, 2010 (JP) ..... 2010-124353

(51) Int. Cl.
*B41J 2/01* (2006.01)

(52) U.S. Cl.
USPC ..... 347/20

(58) Field of Classification Search
USPC ..... 347/20
See application file for complete search history.

(56) References Cited

U.S. PATENT DOCUMENTS

2009/0315957 A1* 12/2009 Koseki ..... 347/68

FOREIGN PATENT DOCUMENTS

| | | |
|---|---|---|
| EP | 2130678 | 9/2009 |
| JP | 09029977 | 2/1997 |

* cited by examiner

*Primary Examiner* — Laura Martin
(74) *Attorney, Agent, or Firm* — Adams & Wilks

(57) ABSTRACT

A liquid jet head has an actuator substrate with discharge and dummy channels alternately arranged so as to extend between front and rear ends of the actuator substrate through intermediation of partition walls. Drive electrodes are arranged on respective ones of the partition walls, and first and second electrode terminals corresponding to the discharge channels are electrically connected to respective ones of the drive electrodes and are arranged on the surface of the actuator substrate in the vicinity of the rear end thereof. A flexible substrate is mounted to the actuator substrate at a vicinity of the rear end thereof. A common wiring electrode and individual wiring electrodes are formed on the flexible substrate. The common wiring electrode is connected in common to the first electrode terminals, and the individual wiring electrodes are individually connected to the second electrode terminals so as to be electrically independent of one another.

20 Claims, 7 Drawing Sheets

LIQUID JET HEAD AND LIQUID JET APPARATUS

BACKGROUND OF THE INVENTION

1. Field of the Invention

The present invention relates to a liquid jet head for discharging liquid from nozzles to form images and characters on a recording medium or to form a thin film material, and also relates to a liquid jet apparatus using the liquid jet head.

2. Description of the Related Art

In recent years, an ink jet system liquid jet head has been used for creating characters and graphics by discharging ink droplets onto a recording sheet or the like, or to forming a pattern of a functional thin film by discharging a liquid material onto a surface of an element substrate. In the ink jet system, ink or a liquid material is supplied from a liquid tank to the liquid jet head through a supply tube, and the ink is loaded into small spaces formed in the liquid jet head. In response to a drive signal, the volume of the small spaces is instantaneously reduced to discharge liquid droplets from nozzles communicating to grooves.

FIG. 10 is an exploded perspective view of an ink jet head 51 of this type. The ink jet head 51 includes a piezoelectric substrate 52 having a plurality of grooves 56 formed in a surface thereof, a cover plate 54 having a liquid supply cell 62 and slits 63 formed therein, a nozzle plate 55 provided with nozzles 64 for discharging liquid, and a flexible substrate 53 for supplying a drive signal generated by a drive circuit to the piezoelectric substrate 52. The grooves 56 have upper openings closed by the cover plate 54 to form channels. The grooves 56 are partitioned by partition walls 57, and on wall surfaces of each partition wall 57, drive electrodes 59 for driving the partition wall 57 are formed. The drive electrodes 59 are connected to electrode terminals 60, which are formed on the surface of the piezoelectric substrate 52 at its rear end RE. The partition walls 57 formed of a piezoelectric body are subjected to polarization processing in a vertical direction. By supplying the drive signal to the drive electrodes formed on both the wall surfaces of the partition wall 57, the partition wall 57 slips to be deformed in the thickness direction. By deforming the partition walls 57 at the time of driving under a state in which the channels formed by the grooves 56 are loaded with liquid in advance, the volume of the channels changes to discharge the ink from the nozzles 64.

FIG. 11 is a schematic top view of the piezoelectric substrate 52 and the flexible substrate 53 in a state in which the flexible substrate 53 bonded to the surface of the piezoelectric substrate 52 in the vicinity of the rear end RE is separated from the piezoelectric substrate 52 and displaced downward of the drawing sheet. The channels formed by the grooves 56 are provided in the surface of the piezoelectric substrate 52, the channels including dummy channels D1 to Dn+1 and discharge channels C1 to Cn for discharging liquid droplets, which are arranged alternately with each other. The drive electrodes 59 for deformably driving each partition wall 57 partitioning the channels are formed on the side surfaces of the partition wall 57. The electrode terminals 60 electrically connected to the drive electrodes 59 of each channel are formed on the surface of the piezoelectric substrate 52 in the vicinity of the rear end RE. For example, drive electrodes 59*c*1 are formed on both side surfaces of both the partition walls 57 on the discharge channel side, the partition walls 57 constituting the discharge channel C1, and the drive electrodes 59*c*1 are connected to a first electrode terminal 60*c*1. A drive electrode 59*d*1 is formed on a side surface of the dummy channel D1 on the discharge channel C1 side, and a drive electrode 59*d*2 is formed on a side surface of the dummy channel D2 on the discharge channel C1 side. Both the drive electrode 59*d*1 and the drive electrode 59*d*2 are electrically connected to a second electrode terminal 60*d*1. The other discharge channels C2 to Cn, the dummy channels D1 to Dn+1, and the first and second electrode terminals 60*c* and 60*d* have the same structures, respectively.

On a surface of the flexible substrate 53 on the piezoelectric substrate 52 side, there are formed wiring electrodes 61 for supplying the drive signal to the drive electrodes 59. As indicated by the arrows of FIG. 11, the flexible substrate 53 is moved to the surface of the piezoelectric substrate 52 on the rear end RE side so as to be bonded to the surface of the piezoelectric substrate 52, with a wiring electrode 61*d*1 electrically connected to the electrode terminal 60*d*1; a wiring electrode 61*c*1, the electrode terminal 60*c*1; and a wiring electrode 61*d*2, an electrode terminal 60*d*2. The same applies to the other wiring electrodes 61.

FIG. 12 is a perspective view illustrating another ink jet head (FIG. 1 of Japanese Patent Application Laid-open No. Hei 9-29977). A plurality of grooves are formed in a lower surface of a piezoelectric ceramic substrate 81 to form channels. A nozzle plate (not shown) is bonded to a surface 84 of the piezoelectric ceramic substrate 81 at its front end portion, and ink cells 82 formed by the grooves communicate to nozzles of the nozzle plate. Drive electrodes are formed on each partition wall partitioning the ink cells 82 provided in the lower surface, and the respective drive electrodes are extended by extension electrodes 86 to a surface 85 via the surface 84. On the surface 84, the electrodes are insulated from one another by insulating portions 83, while on the surface 85, the extension electrodes 86 are electrically insulated from one another by insulating portions 87. The extension electrodes 86 are connected to electric wires 89 at electric connection terminals 88 provided on the upper surface of the piezoelectric ceramic substrate 81 at its rear end, and thereby connected to a drive circuit (not shown). In this example, a pitch W2 of the electric connection terminals 88 is set larger than a pitch W1 of the ink cells 82, to thereby facilitate connection to an external circuit.

In the conventional example illustrated in FIGS. 10 and 11, a pitch P of the connection points between the wiring electrodes 61 formed on the flexible substrate 53 and the electrode terminals 60 needs to be set substantially equal to an arrangement pitch P of the channels formed in the piezoelectric substrate 52. In recent years, however, the arrangement pitch has become smaller and smaller with the increase in number of channels. Therefore, the wiring electrodes 61 of the flexible substrate 53 also need to have a smaller pitch, which requires strict alignment accuracy at the time of alignment and mounting. As a result, there arises such a problem that the manufacturing becomes difficult or manufacturing yields decrease.

Further, in order to form the extension electrodes 86 on the back surface side of the piezoelectric ceramic substrate 81 as illustrated in FIG. 12, the electrode pattern needs to be formed on the surface 84 of the piezoelectric ceramic substrate 81 at its front end and on the upper surface 85 thereof. Therefore, there arises such a problem that the manufacturing process becomes complex and accordingly mass productivity decreases.

SUMMARY OF THE INVENTION

The present invention has been made in view of the above-mentioned circumstances, and it is therefore an object of the present invention to provide a liquid jet head which can be manufactured by a simple manufacturing method and is easy to downsize.

A liquid jet head according to the present invention includes: an actuator substrate including: a plurality of grooves, which are arranged in parallel in a surface of the actuator substrate ranging from a front end thereof to a vicinity of a rear end thereof while being spaced apart from one another through an intermediation of partition walls; drive electrodes, which are arranged on side surfaces of each of the partition walls; and electrode terminals, which are electrically connected to the drive electrodes and arranged on the surface of the actuator substrate in the vicinity of the rear end thereof; a cover plate, which is bonded to the surface of the actuator substrate and closes upper openings of the plurality of grooves to form a plurality of channels; and a flexible substrate, which is bonded to the surface of the actuator substrate in the vicinity of the rear end thereof, and includes wiring electrodes electrically connected to the electrode terminals, in which the plurality of channels include: a discharge channel for discharging liquid; and a dummy channel that does not discharge the liquid, the discharge channel and the dummy channel being arranged alternately with each other, in which the electrode terminals include: a first electrode terminal, which is electrically connected to two drive electrodes each arranged on a side surface on the discharge channel side, of both side surfaces of each of two partition walls constituting the discharge channel; and a second electrode terminal, which is electrically connected to a drive electrode arranged on a side surface of one of the two partition walls of the discharge channel on the dummy channel side, and a drive electrode arranged on a side surface of another one of the two partition walls on the dummy channel side, and in which the wiring electrodes include: a common wiring electrode, which electrically connects the first electrode terminal corresponding to the discharge channel, and another first electrode terminal corresponding to another discharge channel; and a plurality of individual wiring electrodes, which are electrically and individually connected to the second electrode terminal corresponding to the discharge channel and a second electrode terminal corresponding to the another discharge channel.

Further, in each of the discharge channel and the another discharge channel, a first connection point, at which the first electrode terminal is electrically connected to the common wiring electrode, is situated closer to the front end than a second connection point, at which the second electrode terminal is electrically connected to one of the plurality of individual wiring electrodes.

Further, the first connection point and the second connection point are opposed to each other along a longitudinal direction of the discharge channel.

Further, the common wiring electrode is situated closer to an outer periphery of the flexible substrate than the plurality of individual wiring electrodes.

Further, the common wiring electrode intersects the second electrode terminal; and in the intersection therebetween, an insulating film for preventing short-circuit is interposed.

Further, a groove constituting the discharge channel extends from the front end of the actuator substrate to a position on the rear end side short of a position at which the electrode terminals are arranged, and a groove constituting the dummy channel extends from the front end of the actuator substrate to the rear end thereof.

A liquid jet apparatus according to the present invention includes: any one of the above-mentioned liquid jet heads; a moving mechanism for reciprocating the liquid jet head; a liquid supply tube for supplying liquid to the liquid jet head; and a liquid tank for supplying the liquid to the liquid supply tube.

The liquid jet head according to the present invention includes: an actuator substrate including: a plurality of grooves, which are arranged in parallel in a surface of the actuator substrate ranging from a front end thereof to a vicinity of a rear end thereof while being spaced apart from one another through an intermediation of partition walls; drive electrodes, which are arranged on side surfaces of each of the partition walls; and electrode terminals, which are electrically connected to the drive electrodes and arranged on the surface of the actuator substrate in the vicinity of the rear end thereof; a cover plate, which is bonded to the surface of the actuator substrate and closes upper openings of the plurality of grooves to form a plurality of channels; and a flexible substrate, which is bonded to the surface of the actuator substrate in the vicinity of the rear end thereof, and includes wiring electrodes electrically connected to the electrode terminals. Further, the plurality of channels include: a discharge channel for discharging liquid; and a dummy channel that does not discharge the liquid, the discharge channel and the dummy channel being arranged alternately with each other. The electrode terminals include: a first electrode terminal, which is electrically connected to two drive electrodes each arranged on a side surface on the discharge channel side, of both side surfaces of each of two partition walls constituting the discharge channel; and a second electrode terminal, which is electrically connected to a drive electrode arranged on a side surface of one of the two partition walls of the discharge channel on the dummy channel side, and a drive electrode arranged on a side surface of another one of the two partition walls on the dummy channel side. The wiring electrodes include: a common wiring electrode, which electrically connects the first electrode terminal corresponding to the discharge channel, and another first electrode terminal corresponding to another discharge channel; and a plurality of individual wiring electrodes, which are electrically and individually connected to the second electrode terminal corresponding to the discharge channel and a second electrode terminal corresponding to the another discharge channel. With this structure, the number of wiring electrodes on the flexible substrate can be reduced substantially by half as compared to the number of electrode terminals on the actuator substrate. Accordingly, the wiring electrodes can be formed on the flexible substrate with ease and connection between the electrode terminals and the wiring electrodes is facilitated.

DETAILED DESCRIPTION OF THE PREFERRED EMBODIMENTS

Figure 1:
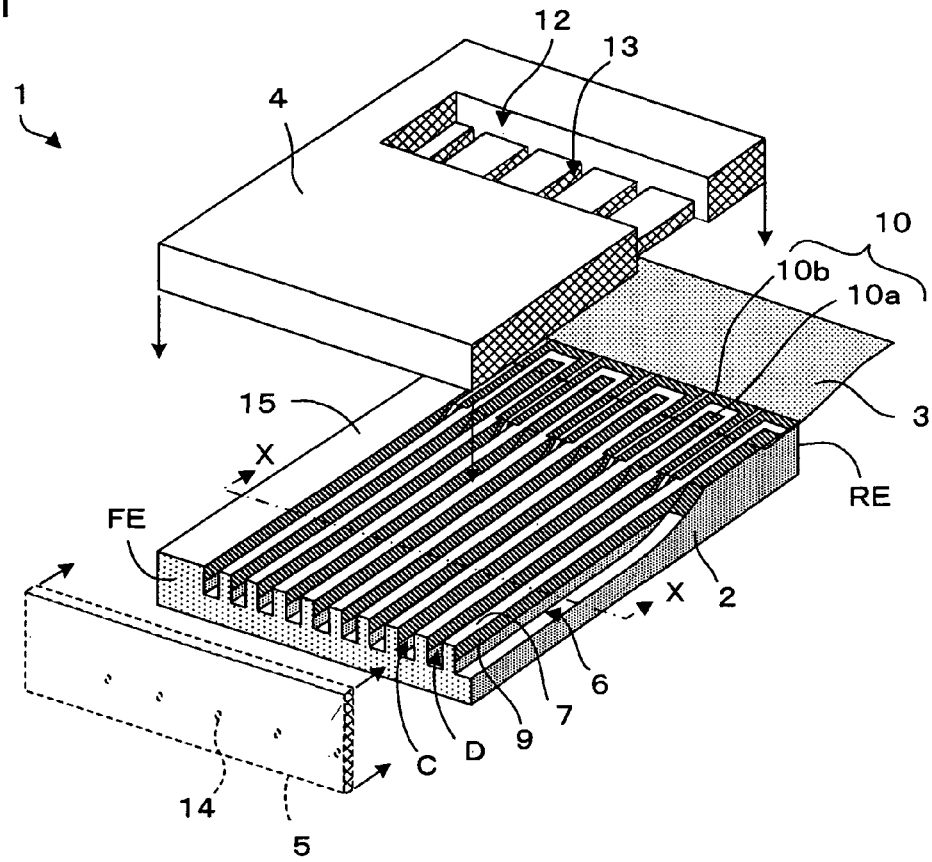
FIG. 1 is a partial exploded perspective view of a liquid jet head according to a first embodiment of the present invention.

A liquid jet head of the present invention includes an actuator substrate having a plurality of grooves formed in a surface thereof, a cover plate bonded to the surface of the actuator substrate, and a flexible substrate for supplying a drive signal to the actuator substrate. The actuator substrate includes the plurality of grooves, which are arranged in parallel in the surface of the substrate ranging from its front end to the vicinity of its rear end while being spaced apart from one another through the intermediation of partition walls, drive electrodes, which are formed on side surfaces of each partition wall, and electrode terminals, which are electrically connected to the drive electrodes and arranged on the surface of the actuator substrate in the vicinity of the rear end. The cover plate closes upper openings of the plurality of grooves formed in the surface of the actuator substrate to forma plurality of channels arranged in parallel. The flexible substrate is bonded to the substrate surface of the actuator substrate in the vicinity of the rear end, and includes wiring electrodes electrically connected to the above-mentioned electrode terminals formed on the actuator substrate.

The plurality of channels arranged in parallel include discharge channels for discharging liquid and dummy channels that do not discharge liquid, the discharge channels and the dummy channels being arranged alternately with each other. The electrode terminals formed in the vicinity of the rear end of the actuator substrate include first electrode terminals and second electrode terminals. The first electrode terminal is electrically connected to two drive electrodes arranged on side surfaces on the discharge channel side, of the side surfaces of two partition walls constituting the discharge channel. The second electrode terminal is electrically connected to a drive electrode arranged on a side surface of one of the partition walls of the discharge channel on the dummy channel side, and a drive electrode arranged on a side surface of the other partition wall on the dummy channel side.

Each partition wall is made of a piezoelectric material. In this case, the entire actuator substrate may be made of the piezoelectric material, or only the partition wall part may be made of the piezoelectric material. The partition wall may produce a large electrostrictive effect when the partition wall is subjected to polarization processing in a direction of the normal of the actuator substrate surface, for example. In this case, the entire partition wall may be subjected to the polarization processing in the direction of the normal, or the polarization direction may be inverted at substantially half the height of the partition wall. Then, the drive signal is supplied to the first electrode terminal and the second electrode terminal to symmetrically deform both the partition walls constituting the discharge channel with the discharge channel set as the center of symmetry. Accordingly, the volume of the discharge channel changes to discharge liquid loaded inside from a nozzle communicating to the discharge channel. In general, the first electrode terminal is connected to a GND and the drive signal is supplied to the second electrode terminal so that the actuator substrate is driven.

The wiring electrodes formed on the flexible substrate include a common wiring electrode and individual wiring electrodes. The common wiring electrode electrically connects in common a first electrode terminal corresponding to one discharge channel and a first electrode terminal corresponding to another discharge channel. The individual wiring electrodes are electrically and individually connected to the second electrode terminals corresponding to the respective discharge channels.

Therefore, in a case where n (n is a positive integer) discharge channels are provided in the actuator substrate, in order to drive those discharge channels, **2*n*** electrode terminals are provided in total, that is, n first electrode terminals and n second electrode terminals. On the other hand, n+1 wiring electrodes only need to be formed on the flexible substrate, for example, one common wiring electrode and n individual wiring electrodes. In other words, according to the liquid jet head of the present invention, the number of wiring electrodes to be formed on the flexible substrate side can be reduced greatly as compared to the number of the electrode terminals formed on the actuator substrate side, and wiring density on the flexible substrate side can be halved substantially. Accordingly, the wiring electrodes can be formed on the flexible substrate with ease, and further, connection between the electrode terminals and the wiring electrodes is facilitated.

In each discharge channel, when a connection point at which the first electrode terminal on the actuator substrate side is electrically connected to the common wiring electrode on the flexible substrate side is defined as a first connection point and a connection point at which the second electrode terminal on the actuator substrate side is electrically connected to the individual wiring electrode on the flexible substrate side is defined as a second connection point, the first connection point is situated closer to the front end of the actuator substrate than the second connection point. With this structure, the pitch of the connection points in the arrangement direction of the respective channels can be increased, with the result that the connection process is facilitated and connection failure can be reduced.

The first connection point and the second connection point may be arranged so as to be opposed to each other along the longitudinal direction of the discharge channel. With this structure, large intervals can be secured for the wiring electrodes and the connection points between adjacent discharge channels, which suits to arrangement of the wiring electrodes with higher density.

The common wiring electrode maybe formed so as to be situated closer to an outer periphery of the flexible substrate than the individual wiring electrode. This structure eliminates the need to form the common wiring electrode between the individual wiring electrodes, with the result that the minimum pitch of the wiring electrodes can be set substantially equal to the pitch of the first electrode terminals. Accordingly, the wiring electrodes can be formed on the flexible substrate with ease and, at the same time, yields of the connection process can be increased. The common wiring electrode has a larger amount of current flowing therethrough than the individual wiring electrode, but a voltage drop due to wiring resistance can be suppressed by increasing the wiring width of the common wiring electrode irrespective of the electrode width and electrode pitch of the individual wiring electrodes.

Further, an insulating film for preventing short-circuit is interposed in an intersection at which the common wiring electrode intersects each second electrode terminal. As a result, the short-circuit can be prevented. The insulating film at the above-mentioned intersection may be arranged on the common wiring electrode side, or may be arranged on the second electrode terminal side. This structure enables the electrode wiring to be laid only on one side of the flexible substrate, which contributes to cost reduction. Hereinbelow, specific description is given with reference to the accompanying drawings.

(First Embodiment)

Figure 2:
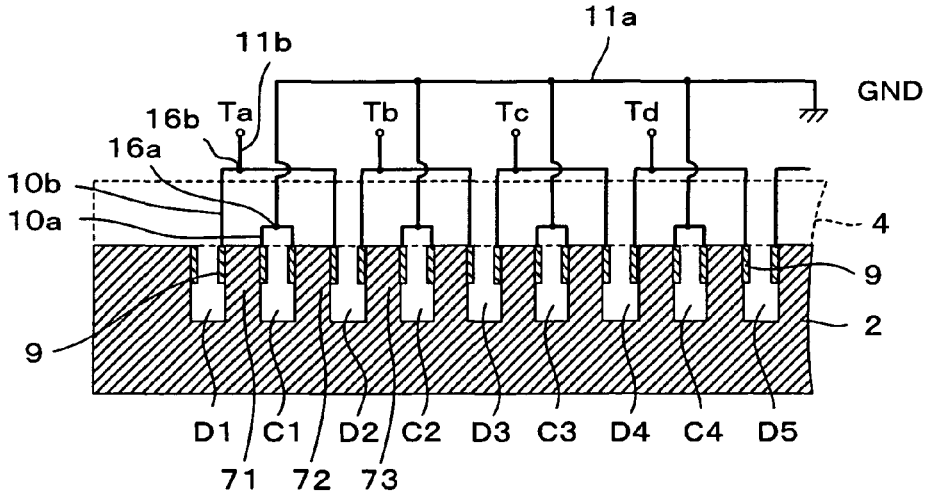
FIG. 2 is a schematic view illustrating a vertical cross section and a circuit structure of the liquid jet head according to the first embodiment of the present invention.
Figure 3:
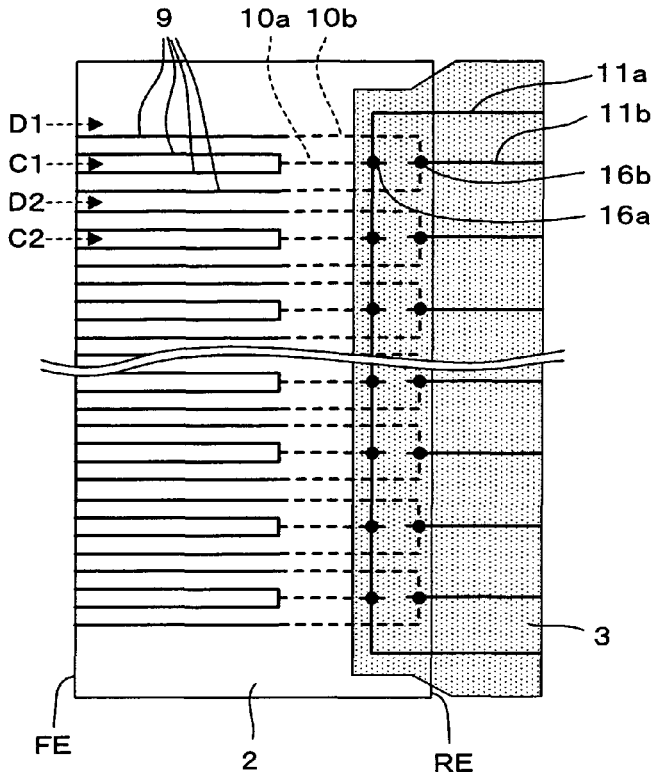
FIG. 3 is a schematic top view illustrating electrode wiring of the liquid jet head according to the first embodiment of the present invention.

FIGS. 1, 2, and 3 are explanatory views illustrating a liquid jet head 1 according to a first embodiment of the present invention. FIG. 1 is a partial exploded perspective view of the liquid jet head 1. FIG. 2 is a schematic view illustrating a vertical cross section of an actuator substrate 2 taken along the arrow XX of FIG. 1 and a circuit structure thereof. FIG. 3 is a schematic view illustrating an upper surface of the actuator substrate 2 in the vicinity of the rear end and electrode wiring of a flexible substrate 3.

As illustrated in FIG. 1, the liquid jet head 1 includes the actuator substrate 2 made of a piezoelectric material, a cover plate 4 bonded to the upper surface of the actuator substrate 2, the flexible substrate 3 bonded to a surface 15 of the actuator substrate 2 in the vicinity of a rear end RE thereof, and a nozzle plate 5 bonded to the actuator substrate 2 at its front end FE. The actuator substrate 2 includes a plurality of grooves 6, which are arranged in parallel in the surface 15 of the substrate ranging from the front end FE to the vicinity of the rear end RE, a plurality of partition walls 7 for spacing the grooves 6 apart from one another, and electrode terminals 10, which are arranged on the surface 15 on the rear end RE side and electrically connected to drive electrodes 9 formed on side surfaces of each partition wall 7.

The actuator substrate 2 is formed as follows. A surface of a piezoelectric substrate is cut with a dicing blade to form the plurality of grooves 6 arranged in parallel. Subsequently, a photosensitive resin sheet is attached to the surface of the piezoelectric substrate, and a pattern is formed through exposure and development. Subsequently, a conductive film is deposited onto the surface of the piezoelectric substrate and the side surfaces of the partition walls 7 by an oblique deposition, and then the photosensitive resin sheet is removed by a lift-off method. As a result, the drive electrodes 9 are formed on the side surfaces of each partition wall 7 and the electrode terminals 10 are formed on the surface 15.

The cover plate 4 includes a liquid supply cell 12 for allowing liquid to flow in, and slits 13 penetrating from a bottom surface of the liquid supply cell 12 to a back surface of the cover plate 4. The cover plate 4 is bonded to the surface of the actuator substrate 2 with adhesive so that the surface of the actuator substrate 2 in the vicinity of the rear end RE is exposed and the slits 13 communicate to upper opening portions of every other grooves 6. The cover plate 4 closes the upper openings of the grooves 6 to form channels. The channels include discharge channels C capable of supplying the liquid from the liquid supply cell 12 through the slits 13, and dummy channels D that do not communicate to the liquid supply cell 12 and hence do not supply the liquid, the discharge channels C and the dummy channels D being arranged alternately with each other. The nozzle plate 5 includes nozzles 14 communicating to the discharge channels C, and is bonded to the actuator substrate 2 and the cover plate 4 at the front end FE.

The electrode terminals 10 include first electrode terminals 10*a* and second electrode terminals 10*b*. The first electrode terminal 10*a* is connected to two drive electrodes 9 formed on side surfaces of two partition walls 7 on the discharge channel side, the partition walls 7 constituting the discharge channel C. The second electrode terminal 10*b* is connected to a drive electrode 9 formed on a side surface of one of the partition walls 7 on the dummy channel D side, the partition walls 7 constituting the discharge channel C, and a drive electrode 9 formed on a side surface of the other partition wall 7 on the dummy channel D side. In other words, in each discharge channel C, the first electrode terminal 10*a* extends from an end portion of the discharge channel C to a position short of the rear end RE, while the second electrode terminal 10*b* extends from both end portions of the dummy channels D situated on both sides of the discharge channel C and surrounds the first electrode terminal 10*a* in an inverted C shape. Then, the flexible substrate 3 is bonded to the surface 15 in the vicinity of the rear end RE.

Referring to FIG. 2, the circuit structure is described. The discharge channels C1 to C4 and the dummy channels D1 to D5 are arranged alternately with each other. For example, the discharge channel C1 is sandwiched by adjacent dummy channels D1 and D2, and a partition wall 71 and a partition wall 72 are respectively interposed between the discharge channel C1 and the dummy channel D1, and between the discharge channel C1 and the dummy channel D2. The first electrode terminal 10*a* is connected to two drive electrodes 9 formed on side surfaces of the discharge channel C1 constituted by the partition wall 71 and the partition wall 72. The second electrode terminal 10*b* is connected to a drive electrode 9 formed on a side surface of the partition wall 71 on the dummy channel D1 side, and a drive electrode 9 formed on a side surface of the partition wall 72 on the dummy channel D2 side.

The flexible substrate 3 includes a common wiring electrode 11*a* and a plurality of individual wiring electrodes 11*b*. The common wiring electrode 11*a* is electrically connected to the first electrode terminal 10*a* corresponding to the discharge channel C1 via a first connection point 16*a*, and is connected to a GND. The other first electrode terminals 10*a* corresponding to the other discharge channels C2 to C4 are similarly connected to the common wiring electrode 11*a* through the other first connection points 16*a*. The individual wiring electrodes 11*b* are electrically connected to the second electrode terminals 10*b* through second connection points 16*b* corresponding to the discharge channels C1 to C4.

For example, in a case of driving the discharge channel C1, a drive signal is supplied to a terminal Ta. Then, an electric field is applied to upper half portions of the partition wall 71 and the partition wall 72 in their thickness direction to cause slip distortion in the thickness direction. As a result, the partition wall 71 and the partition wall 72 are deformed in a "dogleg" shape with reference to a bending point defined at substantially half the height of the partition wall 71 and the partition wall 72. With this structure, the volume of the discharge channel C1 changes to discharge the liquid loaded inside from the nozzle 14. Also in a case of driving the other discharge channels C2 to C4, drive signals are supplied via terminals Tb to Td to the drive electrodes 9 on the dummy channel D2 side to the dummy channel D5 side. The drive electrodes 9 on the discharge channel C1 side to the discharge channel C4 side are set at the GND level, and hence, even if conductive liquid is employed, no drive signal leaks through the liquid.

Referring to FIG. 3, description is given of a layout of the first and second electrode terminals 10*a* and 10*b* on the actuator substrate 2, and the common wiring electrode 11*a* and the individual wiring electrodes 11*b* on the flexible substrate 3. In FIG. 3, the electrode terminals 10 on the actuator substrate 2 are indicated by broken lines, and the wiring electrodes 11 on the flexible substrate 3 are indicated by solid lines.

The first electrode terminals 10*a* and the second electrode terminals 10*b* are formed on the surface 15 of the actuator substrate 2 in the vicinity of the rear end RE. The first electrode terminal 10*a* is electrically connected to the drive electrodes 9 formed on both the side surfaces of the discharge channel C1. The second electrode terminal 10*b* is electrically connected to the two drive electrodes 9 formed on the side surfaces of the dummy channels D1 and D2 on the discharge channel C1 side, the dummy channels D1 and D2 being situated on both sides of the second electrode terminal 10*b*. On the surface 15, the second electrode terminal 10*b* surrounds the first electrode terminals 10*a* in an inverted C shape.

The common wiring electrode 11*a* and the individual wiring electrodes 11*b* are formed on the surface of the flexible substrate 3 on the actuator substrate 2 side. The common wiring electrode 11*a* is arranged so as to surround the individual wiring electrodes 11*b* along an outer periphery of the flexible substrate 3. The common wiring electrode 11*a* is electrically connected to the first electrode terminal 10*a* corresponding to the discharge channel C1 at the first connection point 16*a*. The first electrode terminals corresponding to the other discharge channels are similarly connected in common to the common wiring electrode 11*a* at the other first connection points. The individual wiring electrode 11*b* is electrically connected to the second electrode terminal 10*b* corresponding to the discharge channel C1 at the second connection point 16*b*. The second electrode terminals corresponding to the other discharge channels are similarly electrically connected at the other second connection points. The first connection point 16*a* is situated closer to the front end FE than the second connection point 16*b*.

With this electrode structure, the number of wiring electrodes on the flexible substrate 3 can be reduced substantially by half as compared to the number of electrode terminals on the actuator substrate 2. Accordingly, the wiring electrodes can be formed on the flexible substrate with ease. Further, the pitch of the connection points 16 in the arrangement direction of the respective channels, that is, the direction orthogonal to the grooves 6, is increased, which facilitates the connection process for connecting the first electrode terminals 10*a* and the second electrode terminals 10*b* to the common wiring electrode 11*a* and the individual wiring electrodes 11*b*, respectively. Further, the common wiring electrode 11*a* is arranged along the outer periphery of the flexible substrate 3 so as to surround the individual wiring electrodes 11*b*. Accordingly, even in a case where the number of discharge channels C is increased and the wiring density of the individual wiring electrodes 11*b* is higher, the electrode width of the common wiring electrode 11*a* can be set freely irrespective of the wiring pitch of the individual wiring electrodes 11*b*. As a result, the voltage drop due to the resistance of the common wiring electrode 11*a* can be suppressed.

The second connection point 16*b* may be arranged closer to the rear end RE than the first connection point 16*a* as long as the second connection point 16*b* is situated on the second electrode terminal 10*b*. In this case, the length of the second electrode terminal 10*b* in the direction orthogonal to the channel direction equals a sum of the width of one groove 6 and the thickness of two partition walls 7. Accordingly, the strictness with the alignment accuracy required in aligning the individual wiring electrodes 11*b* to the second electrode terminals 10*b* is eased, with the result that the connection failure can be reduced and the connection process is facilitated. Further, when the first connection point 16*a* and the second connection point 16*b* are arranged so as to be opposed to each other along the longitudinal direction of the discharge channel C as illustrated in FIG. 3, large intervals can be secured for the wiring electrodes and the connection points 16 between adjacent discharge channels, which facilitates the mounting process. Further, the above-mentioned arrangement is preferred when the wiring electrodes 11 are arranged with higher density.

It is noted that the common wiring electrode 11*a* is formed on the flexible substrate 3 along the outer periphery of the flexible substrate 3, but the present invention is not limited thereto. For example, the common wiring electrode 11*a* may be arranged between two individual wiring electrodes 11*b*, or may be formed only along the outer periphery on one side. Further, the wiring electrodes 11 are formed on the surface of the flexible substrate 3 on the actuator substrate 2 side, but the present invention is not limited thereto. For example, the common wiring electrode 11*a* is formed on a surface of the flexible substrate 3 on a side opposite to the actuator substrate 2 side, and the common wiring electrode 11*a* is electrically connected to the first electrode terminals 10*a* at the first connection points 16*a* through a penetration electrode penetrating the flexible substrate 3. With this structure, a short-circuit is prevented with ease through the interposition of the flexible substrate 3 in the intersection at which the common wiring electrode 11*a* intersects each second electrode terminal 10*b*. Further, the flexible substrate 3 may be provided separately for the individual wiring electrodes and for the common wiring electrode. This structure eliminates the need to arrange the common wiring electrode around the individual wiring electrodes, with the result that the contour of each flexible substrate 3 can be reduced and a compact flexible substrate 3 may be formed as a whole.

Further, lead zirconate titanate (PZT) ceramics are used for the actuator substrate 2, and each partition wall 7 is subjected to the polarization processing in the direction of the normal of the substrate surface. The partition wall 7 may have a chevron structure, or the electrodes may be formed on upper half portions or lower half portions of the partition wall 7, the upper half portion and the lower half portion being distinguished at substantially half the height of the partition wall 7. For the cover plate 4, the same material as that for the actuator substrate 2 is used, and for the nozzle plate 5, a polyimide film is used. However, the present invention is not limited to those materials, and needless to say, other materials may be used instead.

The chevron structure mentioned herein has a characteristic in the actuator substrate and hence the structure of the actuator substrate is different from that illustrated in FIG. 2. The structure of the other components is the same as illustrated in FIG. 2. That is, the chevron structure is the same as the above-mentioned structure in that PZT ceramics are used as the material of the actuator substrate, but each partition wall is formed of two PZT ceramic layers subjected to polarization processing so that the polarization directions are opposite to each other in the direction of the normal of the substrate surface. Specifically, the two PZT ceramic layers are laminated so that the polarization directions are opposite to each other, and the drive electrodes are formed on both the upper and lower portions of the side surfaces of the partition wall. With this structure, both the upper and lower portions of the partition wall can be driven by applying a drive voltage.

(Second Embodiment)

Figure 4:
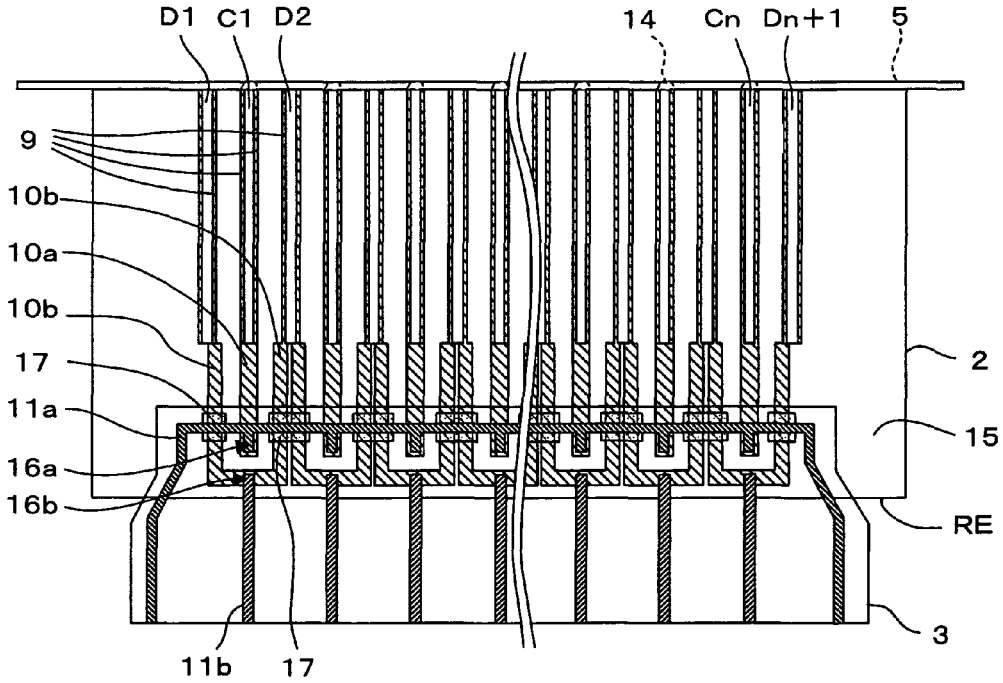
FIG. 4 is a schematic top view of a liquid jet head according to a second embodiment of the present invention.

FIG. 4 is a schematic top view of a liquid jet head 1 according to a second embodiment of the present invention. The liquid jet head 1 of the second embodiment is different from that of the first embodiment in that insulating layers are formed between the second electrode terminals 10*b* formed on the actuator substrate 2 and the common wiring electrode 11*a* formed on the surface of the flexible substrate 3 on the actuator substrate 2 side. Other components of the second embodiment are the same as those of the first embodiment. Therefore, the difference is mainly described below.

The first and second electrode terminals 10*a* and 10*b* are formed on the surface 15 of the actuator substrate 2 in the vicinity of the rear end RE, and the second electrode terminal 10*b* is arranged so as to surround the first electrode terminal 10*a*. The common wiring electrode 11*a* and the individual wiring electrodes 11*b* are formed on the surface of the flexible substrate 3 on the actuator substrate 2 side, and the common wiring electrode 11*a* is formed along the periphery of the flexible substrate 3 so as to surround the individual wiring electrodes 11*b*. The common wiring electrode 11*a* is electrically connected to the first electrode terminal 10*a* corresponding to the discharge channel C1 at the first connection point 16*a* through an anisotropic conductive film (not shown). The other first electrode terminals corresponding to the other discharge channels are similarly connected to the common wiring electrode 11*a*. The individual wiring electrode 11*b* is electrically connected to the second electrode terminal 10*b* corresponding to the discharge channel C1 at the second connection point 16*b* closer to the rear end RE than the first connection point 16*a* through an anisotropic conductive film (not shown).

In this structure, the common wiring electrode 11*a* inevitably intersects the second electrode terminals 10*b* in plan view. Therefore, insulating layers 17 are interposed in the intersections between the common wiring electrode 11*a* and the second electrode terminals 10*b* corresponding to the respective discharge channels, to thereby prevent the short-circuit between the common wiring electrode 11*a* and the second electrode terminals 10*b*.

An insulating film is used as the insulating layer 17. The insulating layer 17 may be attached at each intersection to the flexible substrate 3 side or the actuator substrate 2 side. Further, the insulating film as the insulating layer 17 may be formed so as to cover the surface of the second electrode terminal 10*b* or the common wiring electrode 11*a* at the intersection.

(Third Embodiment)

Figure 5:
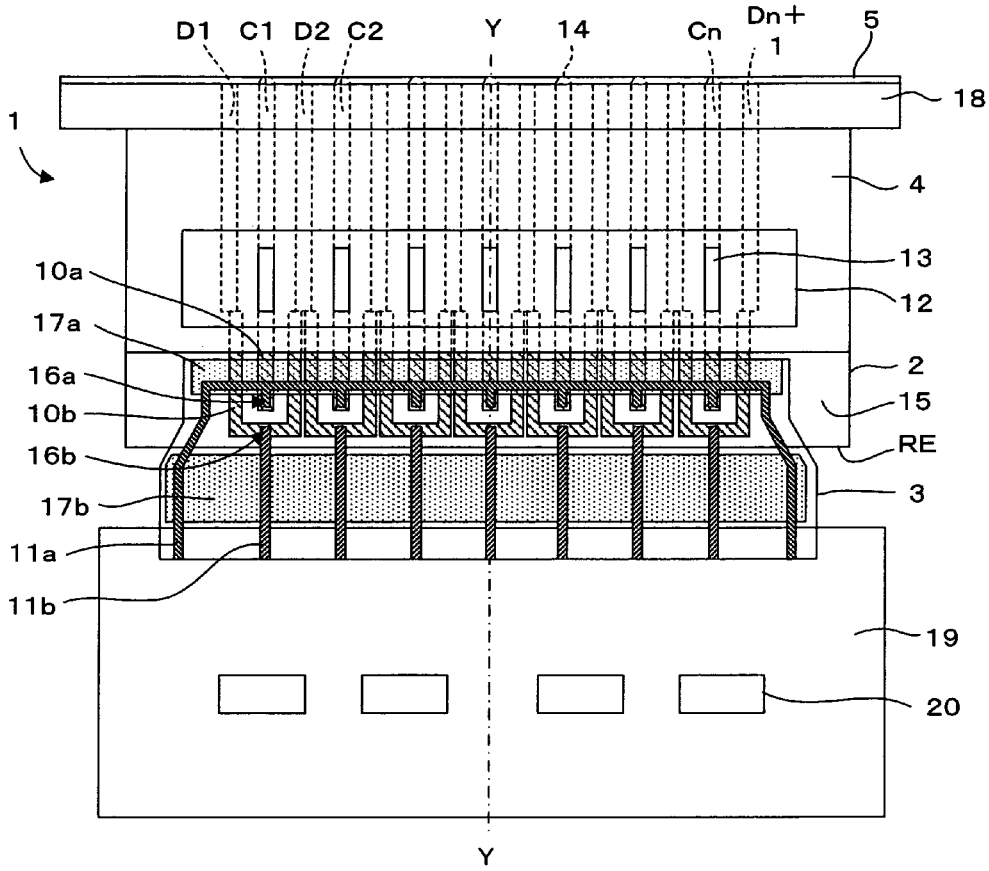
FIG. 5 is a schematic top view of a liquid jet head according to a third embodiment of the present invention.
Figure 6:
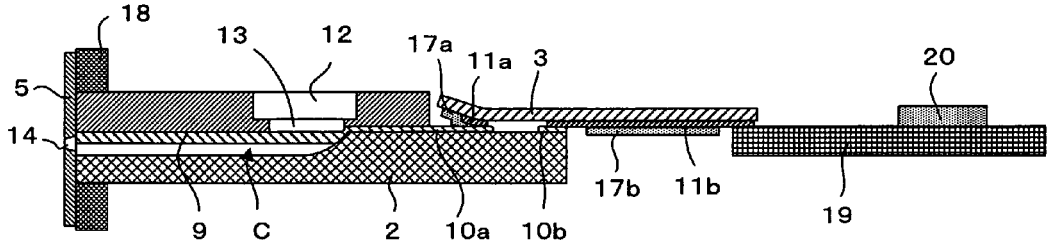
FIG. 6 is a schematic cross-sectional view of the liquid jet head according to the third embodiment of the present invention.
Figure 7:
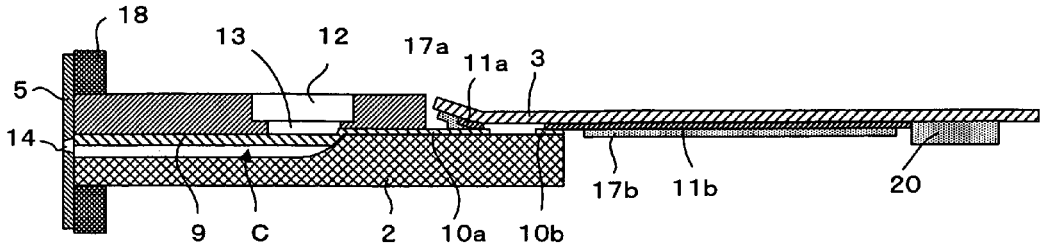
FIG. 7 is a schematic cross-sectional view illustrating a modification example of the liquid jet head according to the third embodiment of the present invention.

FIG. 5 is a schematic top view of a liquid jet head 1 according to a third embodiment of the present invention. FIG. 6 is a schematic cross-sectional view taken along the line YY of FIG. 5. FIG. 7 is a schematic cross-sectional view illustrating a modification example of the third embodiment. The liquid jet head 1 of the third embodiment is different from that of the second embodiment mainly in that an insulating layer 17*a* formed of an insulating film is formed so as to cover the common wiring electrode 11*a* in a part closer to the front end FE than the first connection points 16*a* connecting the common wiring electrode 11*a* and the first electrode terminals 10*a*, to thereby prevent the short-circuit between the second electrode terminals 10*b* and the common wiring electrode 11*a*. The same components or components having the same function are represented by the same reference symbols.

Referring to FIGS. 5 and 6, the structure of the liquid jet head 1 is described. The liquid jet head 1 includes: the actuator substrate 2 made of a piezoelectric material and having the discharge channels C1 to Cn and the dummy channels D1 to Dn+1 arranged on the surface 15 alternately with each other; the cover plate 4 bonded to the surface 15 and having the liquid supply cell 12 and the slits 13 for supplying liquid to the discharge channels C1 to Cn; the nozzle plate 5 including the nozzles 14 communicating to the discharge channels C1 to Cn and bonded to the actuator substrate 2 and the cover plate 4 at the front end FE; a frame member 18 for fixing the actuator substrate 2, the flexible substrate 3, and the cover plate 4; the flexible substrate 3 bonded to the surface 15 of the actuator substrate 2 in the vicinity of the rear end RE, for supplying a drive signal to the actuator substrate 2; and a circuit board 19 having drive ICs 20 mounted thereon, for supplying the drive signal to the flexible substrate 3.

The circuit board 19 has the drive ICs 20 mounted on its surface, and is bonded to the flexible substrate 3 at its end portion on a side opposite to the actuator substrate 2. The circuit board 19 has wires (not shown) on its surface, and one end of each wire is electrically connected to the drive IC 20 while the other end is electrically connected to the common wiring electrode 11*a* or the individual wiring electrode 11*b* on the flexible substrate 3. In other words, the drive signals generated by the drive ICs 20 are transmitted to the electrode terminals 10 on the actuator substrate 2 through the wiring electrodes 11 on the flexible substrate 3, and supplied to the drive electrodes 9 of the respective channels. Note that, the structures of the actuator substrate 2, the cover plate 4, and the nozzle plate 5, and the layout of the electrode terminals 10 and the wiring electrodes 11 are the same as those of the first embodiment or the second embodiment, and detailed description thereof is therefore omitted herein.

The common wiring electrode 11*a* is electrically connected to the first electrode terminal 10*a* corresponding to the discharge channel C1 at the first connection point 16*a* through an anisotropic conductive film (not shown). The first electrode terminals corresponding to the other discharge channels are similarly connected to the common wiring electrode 11*a*. The individual wiring electrode 11*b* is electrically connected to the second electrode terminal 10*b* corresponding to the discharge channel C1 at the second connection point 16*b* through an anisotropic conductive film (not shown). The second electrode terminals corresponding to the other discharge channels have the same structure. The individual wiring electrodes 11*b* are electrically independent of one another.

The first connection point 16*a* is situated closer to the front end FE than the second connection point 16*b*. The insulating layer 17*a* serving as a cover layer is arranged so as to cover the surface of the common wiring electrode 11*a* in a part closer to the front end FE than the first connection points 16*a*. Further, an insulating layer 17*b* is formed on the surface of the flexible substrate 3 in a part between the actuator substrate 2 and the circuit board 19 to protect the surfaces of the wiring electrodes 11. Because the insulating layer 17*a* serving as the cover layer is arranged between the second electrode terminals 10*b* and the common wiring electrode 11*a*, the short-circuit between the second electrode terminals 10*b* and the common wiring electrode 11*a* can be prevented even in a case where the end portion of the flexible substrate 3 on the front end FE side is pressed from above.

In FIG. 7, the circuit board 19 according to the above-mentioned third embodiment is removed and the drive ICs 20 are arranged on the flexible substrate 3. With this structure, the number of parts can be reduced and the assembly process can be performed more quickly. Other components of this modification example are the same as those of the third embodiment, and description thereof is therefore omitted herein.

(Fourth Embodiment)

Figure 8:
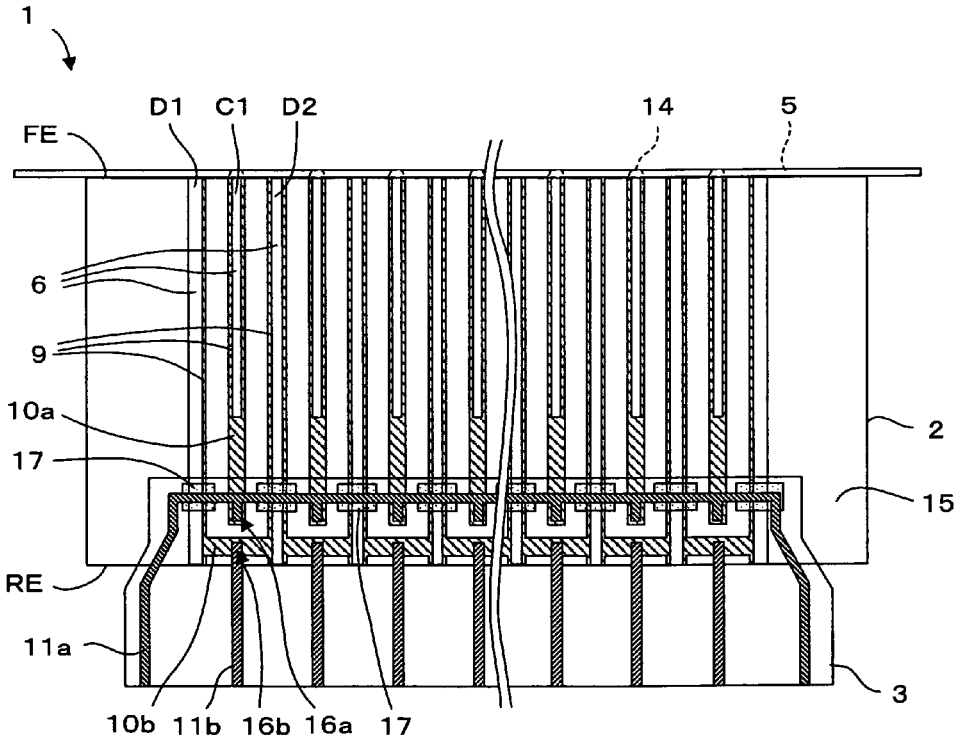
FIG. 8 is a schematic top view of a liquid jet head according to a fourth embodiment of the present invention.

FIG. 8 is a schematic top view of an actuator substrate 2 and a flexible substrate 3 of a liquid jet head 1 according to a fourth embodiment of the present invention. The liquid jet head 1 of the fourth embodiment is different from that of the first embodiment in that the grooves 6 constituting the dummy channels D are formed so as to extend from the front end FE to the rear end RE of the actuator substrate 2. Therefore, the difference is mainly described below. The same components or components having the same function are represented by the same reference symbols.

As illustrated in FIG. 8, the grooves 6 constituting the dummy channels D1 to Dn+1 are formed so as to extend from the front end FE to the rear end RE of the actuator substrate 2, while the grooves 6 constituting the discharge channels C1 to Cn are formed so as to extend from the front end FE to a region short of the vicinity of the rear end RE. Then, the first and second electrode terminals 10*a* and 10*b* are formed on the surface 15 of the actuator substrate 2 in the vicinity of the rear end RE. The first electrode terminal 10*a* is connected to the drive electrodes 9 formed on both the side surfaces of the discharge channel C1, and extends to the vicinity of the rear end RE. The second electrode terminal 10*b* is electrically connected to the drive electrode 9 formed on the side surface of the dummy channel D1 on the discharge channel C1 side, and the drive electrode 9 formed on the side surface of the dummy channels D2 on the discharge channel C1 side. The second electrode terminal 10*b* is formed between the first electrode terminal 10*a* and the rear end RE.

The common wiring electrode 11*a* on the flexible substrate 3 is electrically connected to the first electrode terminal 10*a* on the actuator substrate 2 corresponding to the discharge channel C1 at the first connection point 16*a*. The first electrode terminals 10*a* corresponding to the other discharge channels are similarly electrically connected to the common wiring electrode 11*a*. The individual wiring electrode 11*b* on the flexible substrate 3 is electrically connected to the second electrode terminal 10*b* on the actuator substrate 2 corresponding to the discharge channel C1 at the second connection point 16*b*. For the other discharge channels C, the corresponding individual wiring electrodes 11*b* have the same wiring structure.

Further, the insulating layers 17 are interposed between the common wiring electrode 11*a* and the drive electrodes 9 formed on the side surfaces of the dummy channels D. With this structure, the short-circuit between the common wiring electrode 11*a* and the drive electrodes 9 formed on the side surfaces of the dummy channels D is prevented. Note that, the insulating layer 17 for preventing the short-circuit may be arranged on the upper surface of the common wiring electrode 11*a*, or may be arranged at the electrode intersection on the actuator substrate 2 side. Instead of arranging the insulating layer 17 only at the intersection part, as described in the third embodiment, the insulating layer 17 may be arranged so as to cover the entire surface of the common wiring electrode 11*a* in a part closer to the front end FE than the first connection points 16*a*.

(Fifth Embodiment)

Figure 9:
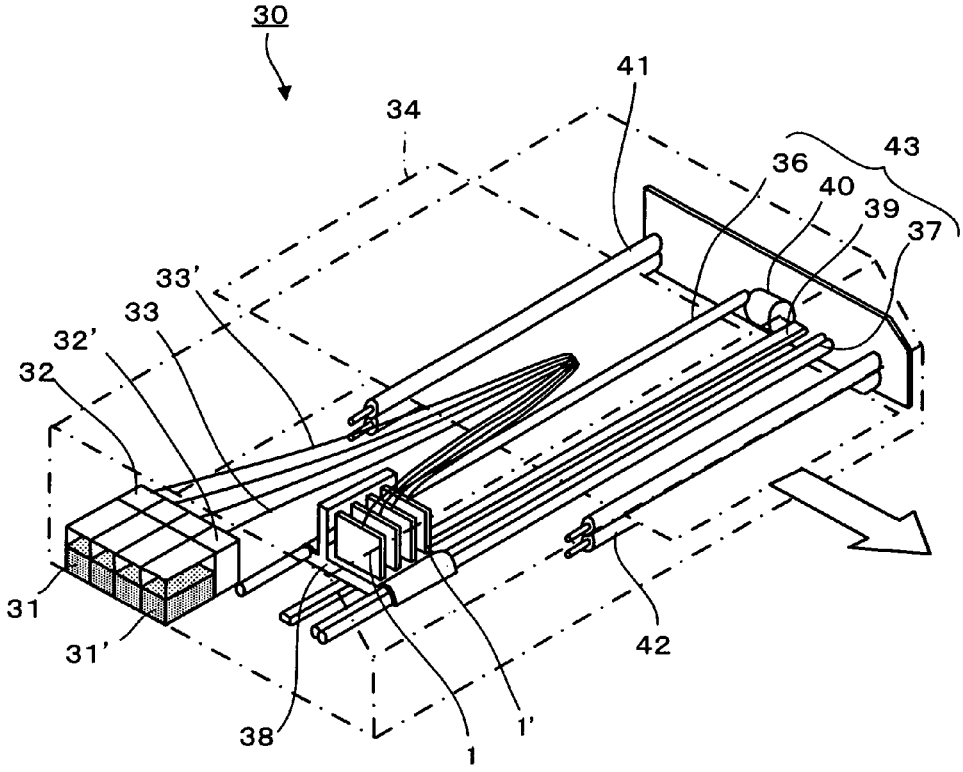
FIG. 9 is a schematic perspective view of a liquid jet apparatus according to a fifth embodiment of the present invention.
Figure 10:
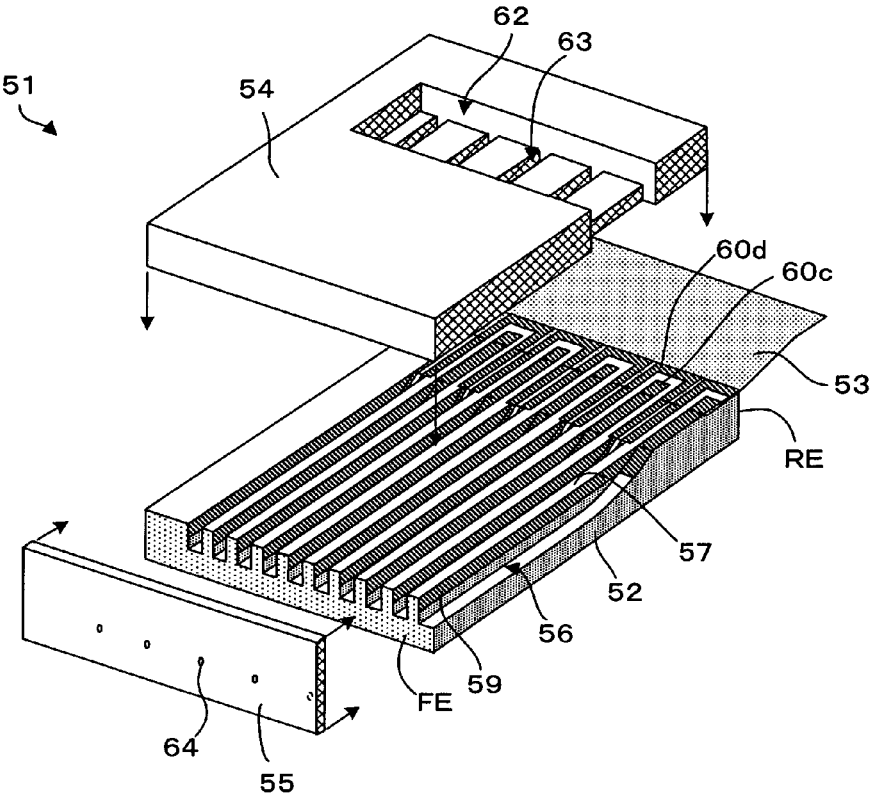
FIG. 10 is a partial exploded perspective view of a conventionally known ink jet head.
Figure 11:
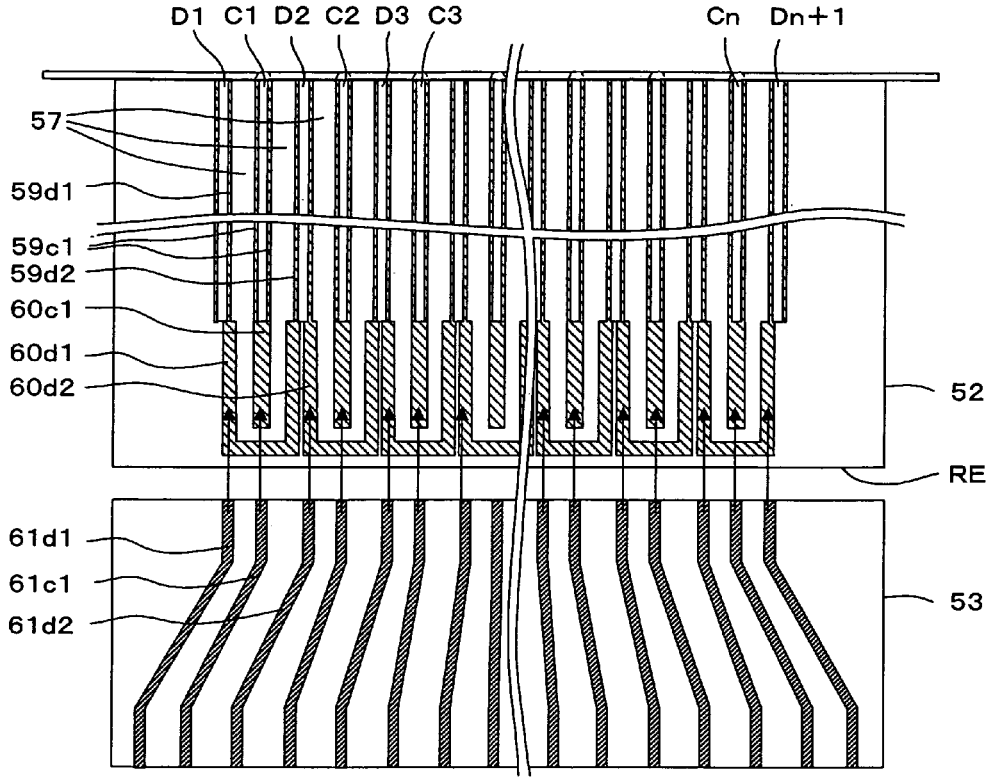
FIG. 11 is a schematic top view of the conventionally known ink jet head.
Figure 12:
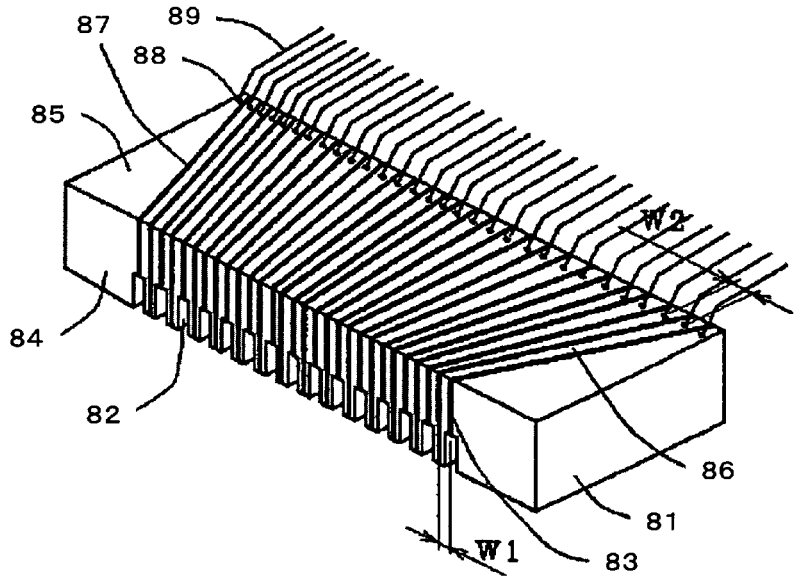
FIG. 12 is a schematic view of the conventionally known ink jet head.

FIG. 9 is a schematic perspective view of a liquid jet apparatus 30 according to a fifth embodiment of the present invention.

The liquid jet apparatus 30 includes a moving mechanism 43 for reciprocating liquid jet heads 1 and 1' according to the present invention described above, liquid supply tubes 33 and 33' for supplying liquid to the liquid jet heads 1 and 1', respectively, and liquid tanks 31 and 31' for supplying the liquid to the liquid supply tubes 33 and 33', respectively. The liquid jet heads 1 and 1' are each constituted by the liquid jet head 1 according to the present invention. Specifically, the liquid jet heads 1 and 1' each include: an actuator substrate having a plurality of grooves arranged in parallel in a surface thereof and partition walls each for spacing adjacent grooves apart from each other; a cover plate covering the grooves and bonded to a surface of the actuator substrate; and a nozzle plate including nozzles communicating to the grooves and bonded to an end surface of the actuator substrate. The actuator substrate includes discharge channels for discharging liquid droplets and dummy channels that do not discharge liquid droplets, the discharge channels and the dummy channels being arranged alternately with each other. On the surface of the actuator substrate 2 in the vicinity of the rear end RE, first electrode terminals and second electrode terminals are arranged. The first electrode terminal is connected to drive electrodes formed on side surfaces of the discharge channel, and the second electrode terminal is connected to drive electrodes formed on side surfaces of the dummy channels on the discharge channel side. The first electrode terminal is situated closer to the front end than the second electrode terminal. On the flexible substrate, a common wiring electrode and individual wiring electrodes are arranged. The common wiring electrode is electrically connected to the first electrode terminals through first connection points, and the individual wiring electrodes are electrically connected to the second electrode terminals through second connection points.

Specific description is given below. The liquid jet apparatus 30 includes: a pair of transport means 41 and 42 for transporting a recording medium 34 such as paper in a main scanning direction; the liquid jet heads 1 and 1' for discharging liquid onto the recording medium 34; pumps 32 and 32' for pressing the liquid stored in the liquid tanks 31 and 31' to supply the liquid to the liquid supply tubes 33 and 33', respectively; and the moving mechanism 43 for moving the liquid jet heads 1 and 1' to perform scanning in a sub-scanning direction orthogonal to the main scanning direction.

The pair of transport means 41 and 42 each extend in the sub-scanning direction, and include a grid roller and a pinch roller that rotate with their roller surfaces coming into contact with each other. The grid roller and the pinch roller are rotated about their shafts by means of a motor (not shown) to transport the recording medium 34 sandwiched between the rollers in the main scanning direction. The moving mechanism 43 includes a pair of guide rails 36 and 37 extending in the sub-scanning direction, a carriage unit 38 capable of sliding along the pair of guide rails 36 and 37, an endless belt 39 to which the carriage unit 38 is connected and thereby moved in the sub-scanning direction, and a motor 40 for revolving the endless belt 39 through pulleys (not shown).

The carriage unit 38 has the plurality of liquid jet heads 1 and 1' placed thereon, and discharges four kinds of liquid droplets, such as yellow, magenta, cyan, and black. The liquid tanks 31 and 31' store liquid of corresponding colors, and supply the liquid through the pumps 32 and 32' and the liquid supply tubes 33 and 33' to the liquid jet heads 1 and 1', respectively. The liquid jet heads 1 and 1' discharge the liquid droplets of the respective colors in response to a drive signal. By controlling the timing to discharge the liquid from the liquid jet heads 1 and 1', the rotation of the motor 40 for driving the carriage unit 38, and the transport speed of the recording medium 34, an arbitrary pattern can be recorded on the recording medium 34.

With this structure, the number of wiring electrodes on the flexible substrate can be reduced as compared to the number of electrode terminals on the actuator substrate, and the wiring density can be halved substantially. Accordingly, the wiring can be laid on the flexible substrate with ease and, at the same time, yields of the connection can be increased.

What is claimed is:

1. A liquid jet head, comprising:

an actuator substrate comprising:

a plurality of grooves arranged in parallel in a surface of the actuator substrate and extending from a front end of the actuator substrate to a vicinity of a rear end of the actuator substrate while being spaced apart from one another through an intermediation of partition walls;

drive electrodes arranged on side surfaces of each of the partition walls; and electrode terminals electrically connected to the drive electrodes and arranged on the surface of the actuator substrate in the vicinity of the rear end thereof;

a cover plate bonded to the surface of the actuator substrate so as to close upper openings of the plurality of grooves to form a plurality of channels;

a flexible substrate bonded to the surface of the actuator substrate in the vicinity of the rear end thereof; and a plurality of wiring electrodes formed on the flexible substrate and electrically connected to the electrode terminals;

wherein the plurality of channels comprise:

a discharge channel for discharging liquid; and a dummy channel that does not discharge the liquid, the discharge channel and the dummy channel being arranged alternately with each other;

wherein the electrode terminals comprise:

a first electrode terminal electrically connected to two drive electrodes formed on side surfaces of two partition walls on the discharge channel side, the two partition walls forming walls of the discharge channel; and a second electrode terminal electrically connected to a drive electrode arranged on a side surface of one of the two partition walls of the discharge channel on the dummy channel side, and electrically connected to a drive electrode arranged on a side surface of another one of the two partition walls on the dummy channel side; and wherein the wiring electrodes comprise:

a common wiring electrode electrically connecting the first electrode terminal corresponding to the discharge channel with another first electrode terminal corresponding to another discharge channel; and a plurality of individual wiring electrodes electrically and individually connected to the second electrode terminal corresponding to the discharge channel and a second electrode terminal corresponding to the another discharge channel.

2. A liquid jet head according to claim 1, wherein in each of the discharge channel and the another discharge channel, a first connection point at which the first electrode terminal is electrically connected to the common wiring electrode is situated closer to the front end than a second connection point, at which the second electrode terminal is electrically connected to one of the plurality of individual wiring electrodes.

3. A liquid jet head according to claim 2, wherein the first connection point and the second connection point are opposed to each other along a longitudinal direction of the discharge channel.

4. A liquid jet head according to claim 3, wherein the common wiring electrode is disposed closer to an outer periphery of the flexible substrate than the plurality of individual wiring electrodes.

5. A liquid jet head according to claim 2, wherein the common wiring electrode is positioned closer to an outer periphery of the flexible substrate than the plurality of individual wiring electrodes.

6. A liquid jet head according to claim 1, wherein the common wiring electrode is positioned closer to an outer periphery of the flexible substrate than the plurality of individual wiring electrodes.

7. A liquid jet head according to claim 1, wherein the common wiring electrode intersects the second electrode terminal; and further comprising an insulating film interposed at the intersection between the common wiring electrode and the second electrode terminal for preventing a short-circuit therebetween.

8. A liquid jet head according to claim 1, wherein the discharge channel comprises a groove extending from the front end of the actuator substrate to a position on the rear end side short of a position at which the electrode terminals are arranged; and wherein the dummy channel comprises a groove extending from the front end of the actuator substrate to the rear end thereof.

9. A liquid jet apparatus, comprising:

the liquid jet head according to claim 1;

a moving mechanism for reciprocating the liquid jet head;

a liquid supply tube for supplying liquid to the liquid jet head; and a liquid tank for supplying the liquid to the liquid supply tube.

10. A liquid jet head according to claim 9, wherein the common wiring electrode and the plurality of individual wiring electrodes are formed on an actuator substrate side of the flexible substrate.

11. A liquid jet head according to claim 1, wherein the common wiring electrode is connected to the first electrode terminals at first connection points; and further comprising an insulating film covering the common wiring electrode at apart closer to the front end of the actuator substrate than the first connection points to thereby prevent a short-circuit between the second electrode terminals and the common wiring electrode.

12. A liquid jet head comprising:

an actuator substrate;

a plurality of grooves formed in a surface of the actuator substrate to provide a plurality of discharge channels that are configured to discharge a liquid and a plurality of dummy channels that are not configured to discharge the liquid, the discharge and dummy channels extending between front and rear ends of the actuator substrate and being alternately arranged in parallel on the surface of the actuator substrate through intermediation of partition walls;

a plurality of drive electrodes arranged on side surfaces of respective ones of the partition walls;

a plurality of electrode terminals electrically connected to respective ones of the drive electrodes, the electrode terminals including first and second electrode terminals corresponding to the discharge channels and being arranged on the surface of the actuator substrate in the vicinity of the rear end thereof;

a flexible substrate mounted to the surface of the actuator substrate at a vicinity of the rear end thereof; and a plurality of wiring electrodes including a common wiring electrode and a plurality of individual wiring electrodes formed on the flexible substrate, the common wiring electrode being connected in common to the first electrode terminals, and the individual wiring electrodes being individually connected to the second electrode terminals so as to be electrically independent of one another.

13. A liquid jet head according to claim 12, wherein the common wiring electrode and the individual wiring electrodes are formed on an actuator substrate side of the flexible substrate.

14. A liquid jet head according to claim 12, further comprising a cover plate bonded to the surface of the actuator substrate so as to close upper openings of the plurality of grooves to form the discharge and dummy channels.

15. A liquid jet head according to claim 12, wherein the common wiring electrode is positioned closer to an outer periphery of the flexible substrate than the individual wiring electrodes.

16. A liquid jet head according to claim 12, wherein the common wiring electrode intersects the second electrode terminal; and further comprising an insulating film interposed at the intersection between the common wiring electrode and the second electrode terminal for preventing a short-circuit therebetween.

17. A liquid jet head according to claim 12, wherein each of the discharge channels extends from the front end of the actuator substrate to a position on the rear end side short of a position at which the electrode terminals are arranged; and wherein each of the dummy channels extends from the front end of the actuator substrate to the rear end thereof.

18. A liquid jet head according to claim 12, wherein the common wiring electrode is connected to the first electrode terminals at first connection points; and further comprising an insulating film covering the common wiring electrode at a part closer to the front end of the actuator substrate than the first connection points to thereby prevent a short-circuit between the second electrode terminals and the common wiring electrode.

19. A liquid jet apparatus, comprising:

the liquid jet head according to claim 18;

a moving mechanism for reciprocating the liquid jet head;

a liquid supply tube for supplying liquid to the liquid jet head; and a liquid tank for supplying the liquid to the liquid supply tube.

20. A liquid jet apparatus, comprising:

the liquid jet head according to claim 12;

a moving mechanism for reciprocating the liquid jet head;

a liquid supply tube for supplying liquid to the liquid jet head; and a liquid tank for supplying the liquid to the liquid supply tube.

* * * * *